United States Patent [19]

Verhulst et al.

[11] 3,991,233

[45] Nov. 9, 1976

[54] METHOD OF MANUFACTURING A MAGNETIZABLE LAYER FOR A MAGNETIC DOMAIN DEVICE

[75] Inventors: Antonius Gerardus Hendrikus Verhulst; Willem Frederik Druyvesteyn; Jan Haisma; Ulrich Ernst Enz, all of Eindhoven, Netherlands

[73] Assignee: U.S. Philips Corporation, New York, N.Y.

[22] Filed: Apr. 24, 1975

[21] Appl. No.: 571,406

[30] Foreign Application Priority Data

May 13, 1974 Netherlands ..... 7406382

[52] U.S. Cl. ..... 427/130; 427/131

[51] Int. Cl.[2] ..... H01F 10/02

[58] Field of Search ..... 427/127–132

[56] References Cited

OTHER PUBLICATIONS

Appl. Phys. Lett. vol. 22, No. 1, Jan. 73, Lin, pp. 29–30.

*Primary Examiner*—Bernard D. Pianalto

*Attorney, Agent, or Firm*—Frank R. Trifari; Carl P. Steinhauser

[57] ABSTRACT

A method of manufacturing a magnetizable layer having domains with at most two Bloch walls for a magnetic domain device in which a monocrystalline layer of $Y_{3-x}La_xFe_{5-Y}Ga_YO_{12}$, wherein $0.1 \leqq X \leqq 0.2$ and $1.0 \leqq Y \leqq 1.5$ is provided on a monocrystalline substrate and is covered with an SiO-containing layer after which the monocrystalline layer is maintained at a temperature between 300° C and 600° C for some time.

1 Claim, No Drawings

METHOD OF MANUFACTURING A MAGNETIZABLE LAYER FOR A MAGNETIC DOMAIN DEVICE

The invention relates to a method of manufacturing a magnetisable layer for a magnetic domain device, in which a monocrystalline magnetisable layer consisting of a ferrite having garnet structure is provided on a monocrystalline substrate body. The monocrystalline magnetisable layer can be provided on the monocrystalline substrate body in various manners, for example, by means of liquid phase epitaxy or by means of chemical vapour deposition. When the magnetic device is used, means are present to generate magnetic domains, means to maintain magnetic domains in the layer, and possibly means to annihilate magnetic domains. The means for maintaining and possibly annihilating the magnetic domains in the layer maybe an external magnetic field $H_o$ the direction of which coincides, at least mainly, with the easy axis of magnetisation of the layer which is substantially normal to the surface of the layer. the magnetic domains are, for example, circular cylindrical and they can exist in a stable form only with magnetic fields $H_o$ the strength of which is between certain limits. Those limit values for the field depend inter alia on the thickness of the layer in which the domains occur and on the chemical composition thereof. The domains may also be annular or strip-shaped.

The change of the direction of the magnetisation within a domain to the opposite direction outside the domain is formed by a wall. A wall may have various shapes and as a result thereof the domains have different properties. For example, the limits of the magnetic field $H_o$ within which the domains exist in a stable form are different. Furthermore, the differences manifest themselves in particular during the movement of the domains. A description of such various types of walls is given in "The Bell System Technical Journal", volume 51, No. 6, July-August, 1972, p.p. 1427–1431. In a given case the whole wall is a so-called Bloch wall. In another case the wall comprises a large number of Bloch wall parts and also a large number of Neel wall parts. The former case is termed a normal domain and the second case is termed a hard domain; domains having a wall between those two extremities are referred to as intermediate domains.

Since domains having walls of various shapes behave differently during the movement of the domains, a magnetic device in which domains having walls of different shapes occur, exhibits considerable drawbacks during use. For suppressing hard domains, "The Bell System Technical Journal" volume 51, No. 6, July-August 1972, pp. 1431–1435 describes a construction of two magnetisable layers the compensation temperatures of which are on either side of room temperature. The two magnetisable layers are provided successively. As described on page 1435, the manufacture of a construction having a number of layers adds another complication to the method manufacturing magnetisable layers in which domains occur. As an alternative method is mentioned the use of ion implantation in a single layer. In connection with the high electric fields required for ion implantation, this solution also results in complications.

The invention provides a method in which a construction is realised in a simple manner and in which no hard domains occur. According to the invention, a layer having a composition $Y_{3-x}La_xFe_{5-y}Ga_yO_{12}$ wherein $0.1 \leqq x \leqq 0.2$ and $1.0 \leqq y \leqq 1.5$ is provided on the monocrystalline substrate body, an SiO-containing layer is then provided hereon and the layer of ferrite is maintained at a temperature between 300° C and 600° C for some time. During this temperature treatment, the composition of the upper part of the layer of ferrite changes. The compensation temperature of the said ferrite composition is close to room temperature, i.e. about 20° C. The change in composition occurring during the temperature treatment has for its result that the compensation temperature of the upper part of the layer of ferrite changes just to the other side of room temperature. In this manner a construction is realised with component layers the compensation temperatures of which are on either side of room temperature.

An SiO-containing layer is provided on the layer of ferrite. This is, for example, a layer consisting of SiO and Si or a layer consisting of SiO and $SiO_2$ or a layer consisting of SiO, Si and $SiO_2$. The provision of said layer may be carried out in various manners, for example, by sputtering or by chemical vapour deposition. The thickness of the SiO-containing layer is not critical.

The temperature treatment takes place between 300° C and 600° C, that is to say below the growth temperature of the ferrite. The lower limit is determined by the fact that ion transport between the two layers and in the layer of ferrite takes place within a reasonable time. The time during which the temperature treatment takes place depends, of course, on the temperature. When the SiO-containing layer is provided at elevated temperature, the two method steps take place simultaneously.

The invention will be described in greater detail with reference to the following example.

EXAMPLE

A layer of a magnetic ferrite having garnet structure and a composition $Y_{2.85}La_{0.15}Fe_{3.75}Ga_{1.25}O_{12}$ is provided in a thickness of approximately 5$\mu$m on a monocrystalline disk of $Gd_3Ga_5O_{12}$ by means of liquid phase epitaxy at a temperature between 900° C and 1000° C. The monocrystalline disk with the layer of ferrite present thereon is placed in a holder of a sputtering device. The temperature of the holder is approximately 200° C. An SiO-containing layer originating from an SiO-containing source is sputtered on the layer of ferrite for 1 hour. During said treatment the particles released from the SiO-containing source obtain such a kinetic energy that they impinge on the layer of ferrite and covert said energy locally into thermal energy so that the layer of ferrite reaches a temperature between 300° C and 600° C. In this manner an SiO-containing layer is obtained with a thickness of approximately 1$\mu$m and an ion transport has taken place between the two layers and in the layers of ferrite. When said layer of ferrite is used in a magnetic domain device, it is found that the domains are stable for values for the field $H_o$ between the limits which apply to a normal domain so that in practice they behave as normal domains. This means that the domains occuring in the layer comprise at most two Bloch wall parts.

What is claimed is:

1. A method of manufacturing a magnetisable layer for a magnetic domain device, comprising the steps of coating a monocrystalline substrate body with a monocrystalline magnetisable layer having a given compensation temperature on one side of a temperature of about 20° C consisting of a ferrite having a garnet structure and having a composition $Y_{3-x}La_xFe_{5-y}Ga_yO_{12}$ wherein $0.1 \leqq x \leqq 0.2$ and $1.0 \leqq y \leqq 1.5$, thereafter coating the monocrystalline magnetisable layer with an SiO-containing layer and heating said monocrystalline mangetisable layer to a temperature between 300°

C and 600° C for a time sufficient to change the compensation temperature of the upper portion of said monocrystalline magnetisable layer to be on the other side of said temperature of about 20° C and magnetic domains in said layer comprise at most two Bloch wall parts.

* * * * *